US011031740B2

(12) United States Patent
Nogawa et al.

(10) Patent No.: US 11,031,740 B2
(45) Date of Patent: Jun. 8, 2021

(54) COAXIAL CABLE ELECTRICAL CONNECTOR

(71) Applicant: Molex, LLC, Lisle, IL (US)

(72) Inventors: Yoshiteru Nogawa, Yamato (JP); Toshihiro Niitsu, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/840,452

(22) Filed: Apr. 6, 2020

(65) Prior Publication Data

US 2020/0343674 A1 Oct. 29, 2020

(30) Foreign Application Priority Data

Apr. 23, 2019 (JP) ..... JP2019-081892

(51) Int. Cl.
*H01R 13/6593* (2011.01)
*H01R 13/502* (2006.01)

(52) U.S. Cl.
CPC ..... *H01R 13/6593* (2013.01); *H01R 13/502* (2013.01)

(58) Field of Classification Search
CPC ..... H01R 13/6593; H01R 13/502
See application file for complete search history.

(56) References Cited

U.S. PATENT DOCUMENTS 5,980,308 A * 11/1999 Hu ..... H01R 12/598 439/497
6,951,477 B2 * 10/2005 Tondreault ..... H01R 12/596 439/497
7,497,724 B1 * 3/2009 Fong ..... H01R 9/2416 439/497
8,992,262 B2 * 3/2015 Pang ..... H01R 13/6471 439/626
9,705,273 B2 * 7/2017 Guetig ..... H01R 43/16
9,917,401 B2 * 3/2018 Nagase ..... H01R 13/6272
2005/0176305 A1 * 8/2005 Wu ..... H01R 13/405 439/660
2012/0315796 A1 * 12/2012 Pang ..... H01R 13/6471 439/626
2013/0164990 A1 * 6/2013 Tsai ..... H01R 24/62 439/660

(Continued)

FOREIGN PATENT DOCUMENTS

CN 201576802 U 9/2010
CN 202550122 U 11/2012

(Continued)

*Primary Examiner* — Abdullah A Riyami
*Assistant Examiner* — Nader J Alhawamdeh

(57) ABSTRACT

A ground terminal is integrally formed with one ground coupling member extending in a width direction; a housing is integrally formed with a signal terminal, the ground terminal, and the ground coupling member by insert molding; the signal terminal has a contact portion that comes into contact with a counterpart signal terminal and a tail portion soldered to a core wire of a coaxial cable exposed from the housing; the ground coupling member includes a shield connecting portion that is exposed from the housing on a rear side of the tail portion of the signal terminal and soldered to a shield of the coaxial cable; and the ground terminal has a portion other than the contact portion embedded in the housing.

9 Claims, 7 Drawing Sheets

(56) References Cited

U.S. PATENT DOCUMENTS

| | | | | |
|---|---|---|---|---|
| 2014/0187087 | A1* | 7/2014 | Mason | H01R 13/6594 439/607.36 |
| 2016/0156116 | A1* | 6/2016 | Kurachi | H01R 13/6581 439/78 |
| 2019/0267732 | A1* | 8/2019 | Buck | H01R 12/85 |
| 2020/0343674 | A1* | 10/2020 | Nogawa | H01R 13/405 |

FOREIGN PATENT DOCUMENTS

| | | | |
|---|---|---|---|
| CN | 203466377 | U | 3/2014 |
| CN | 203707440 | U | 7/2014 |
| CN | 204103096 | U | 1/2015 |
| JP | 2001-068226 | A | 3/2001 |
| JP | 2009170142 | A | 7/2009 |
| JP | 2012-049035 | A | 3/2012 |
| JP | 2014130772 | A | 7/2014 |

* cited by examiner

COAXIAL CABLE ELECTRICAL CONNECTOR

RELATED APPLICATION

This application claims priority to Japanese Application Serial No. 2019-081892, filed on Apr. 23, 2019, which is incorporated by reference in its entirety.

TECHNICAL FIELD

The present disclosure relates to a connector.

BACKGROUND ART

In the past, in an electronic device or an electric device, when connecting a coaxial cable that transmits a high-frequency signal to a substrate such as a printed circuit board, the coaxial cable is connected to a coaxial multi-pole connector that includes a signal terminal connected to a signal wire of a coaxial cable and a shield terminal that surrounds the signal terminal and is connected to a shield of the coaxial cable, and is mounted on a substrate (see e.g., Patent Document 1).

FIG. 7 is a schematic plan view showing a state in which a coaxial cable is connected to a known connector.

In the figure, a plurality of terminals 813 housed in a housing of the connector is arrayed to be aligned in a vertical direction in the figure. Each terminal 813 is an elongated member formed by performing processing such as die-cutting and bending on a conductive metal plate, and is extended in a left-right direction in the figure. Note that the terminal 813 includes a signal terminal 813*a* and a shield terminal 813*b*.

Additionally, a shield bar 814 is an elongated member formed by performing processing such as die-cutting and bending on a conductive metal plate, and is extended in the vertical direction in the figure. A leg portion 814*a* of the shield bar 814 is soldered to the shield terminal 813*b* by a solder connecting portion w3.

Furthermore, a coaxial cable 891 used for high-speed transmission includes a core wire 892 made of a conductive metal; an insulating body (not shown) that surrounds an outer periphery of the core wire 892; a shield 893 made of a conductive net that surrounds an outer periphery of the insulating body; and an outer covering 894 having an insulating property that surrounds an outer periphery of the shield 893. The core wire 892 is soldered to the signal terminal 813*a* by the solder connecting portion w2, and the shield 893 is soldered to the shield bar 814 by the solder connecting portion w1. Thus, the ground potential of all of the shield terminals 813*b* and the shield 893 can be shared.

In the example shown in the figure, a low-speed transmission signal wire 896 is connected to the signal terminal 813*a*, and a low-speed transmission shield wire 897 is connected to the leg portion 814*a* of the shield bar 814, however, description on the low-speed transmission signal wire 896 and the low-speed transmission shield wire 897 is omitted.

Patent Document 1: Japanese Unexamined Patent Publication No. 2012-049035

SUMMARY

However, in the known connector, the solder connecting portion w2 in the adjacent signal terminal 813*a* and the solder connecting portion w3 in the shield terminal 813*b* are in close proximity to each other, so that during the soldering work, the molten solder of the solder connecting portion w2 and the solder connecting portion w3 may fuse, causing the adjacent signal terminals 813*a* or the signal terminals 813*a* and the shield terminal 813*b* to short circuit. In particular, in recent years, miniaturization of connectors is advancing with advancement in miniaturization of electric devices, electronic devices, and the like, and thus the spacing between adjacent terminals 813 is becoming narrower, which increases the possibility of the molten solder fusing and the adjacent terminals 813 short circuiting, and makes the soldering work difficult.

An object of the present disclosure is to solve the problems of the known connector, and to provide a highly reliable connector in which number of components can be reduced and the cost can be reduced, noise can be suppressed thus stabilizing the signal quality, and the soldering work can be carried out easily and surely.

To this end, a connector includes at least one signal terminal extending in a front-rear direction; at least two ground terminals extending in the front-rear direction disposed on both sides in a width direction of the signal terminal; and a housing that holds the signal terminal and the ground terminal; wherein: all of the ground terminals are integrally formed with one ground coupling member extending in the width direction; the housing is integrally formed with the signal terminal, the ground terminal, and the ground coupling member by insert molding; the signal terminal has a contact portion that comes into contact with a counterpart signal terminal and a tail portion soldered to a core wire of a coaxial cable exposed from the housing; the ground coupling member includes a shield connecting portion that is exposed from the housing on a rear side of the tail portion of the signal terminal and soldered to a shield of the coaxial cable; and the ground terminal has a portion other than a contact portion that comes into contact with a counterpart ground terminal embedded in the housing.

In another connector, the signal terminal is provided as a plurality, a number of the ground terminals is a number only one larger than a number of the signal terminals, and the signal terminals and the ground terminals are arranged to be alternately aligned in one row in the width direction.

Furthermore, in yet another connector, the contact portion of the ground terminal is located at a same height as the contact portion of the signal terminal, and the shield connecting portion of the ground coupling member is located at a position lower than the tail portion of the signal terminal.

Moreover, in yet another connector, the housing includes a cable accommodating groove that extends in the front-rear direction formed in the upper surface, and the tail portion of the signal terminal and the shield connecting portion of the ground coupling plate are exposed at the bottom surface of the cable accommodating groove.

Furthermore, in yet another connector, the housing includes a rib portion that extends in the front-rear direction formed on both sides of the cable accommodating groove, and a majority of the portion of the ground terminal embedded within the housing is located below the rib portion.

In yet another further connector, the signal terminal includes a main body portion connected to a rear end of the contact portion; the tail portion is wider than the contact portion and the main body portion and is connected to a rear end of the main body portion; the ground terminal includes a main body portion connected to a rear end of the contact portion and a coupling portion connected to a rear end of the main body portion; and the coupling portion has a narrower width than the contact portion and the main body portion.

Furthermore, in still another connector, the coupling portion includes a stepped portion, and a rear end is integrally connected to the ground coupling member.

In still another connector, the housing includes holes opened to an upper surface and a lower surface at positions corresponding to the main body portion of the signal terminal and the main body portion of the ground terminal.

In still another connector, a shell in which at least a part of the housing is accommodated is further provided, and the ground terminal is electrically separated from the shell.

According to the present disclosure, the connector can reduce the number of parts and reduce the cost, can suppress noise, thus stabilizing signal quality, can perform soldering easily and surely, and can improve reliability.

BRIEF DESCRIPTION OF THE DRAWINGS

FIG. 5A is a plan view and FIG. 5B is a perspective view.

FIG. 6A is a plan view, FIG. 6B is a cross-sectional view taken along line A-A in FIG. 6A, and FIG. 6C is a cross-sectional view taken along line B-B in FIG. 6A.

DETAILED DESCRIPTION OF PREFERRED EMBODIMENTS

An embodiment will be described in detail below with reference to the drawings.

Figure 1:
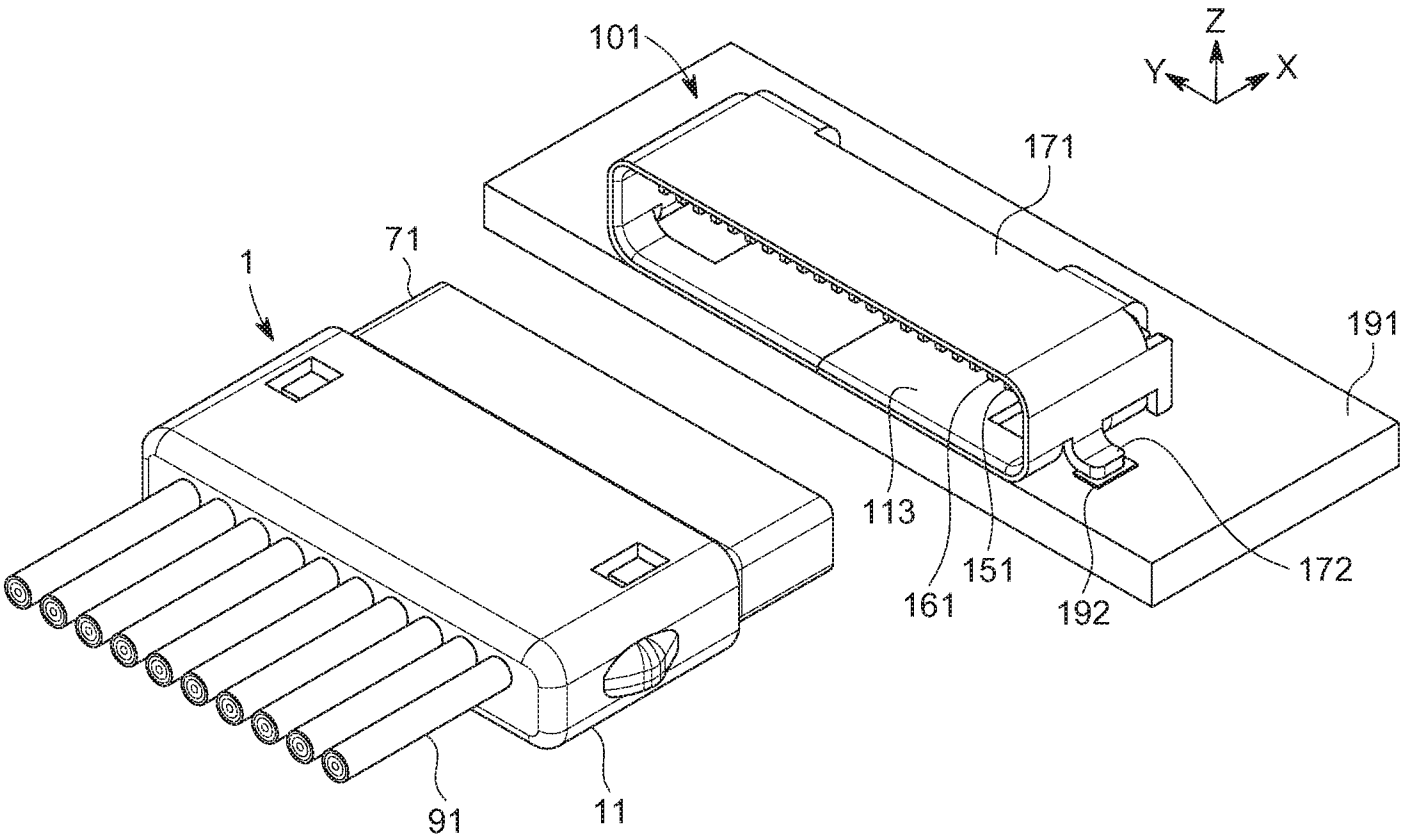
FIG. 1 is a perspective view showing a state before fitting of a cable connector and a substrate connector according to the present embodiment.
Figure 2:
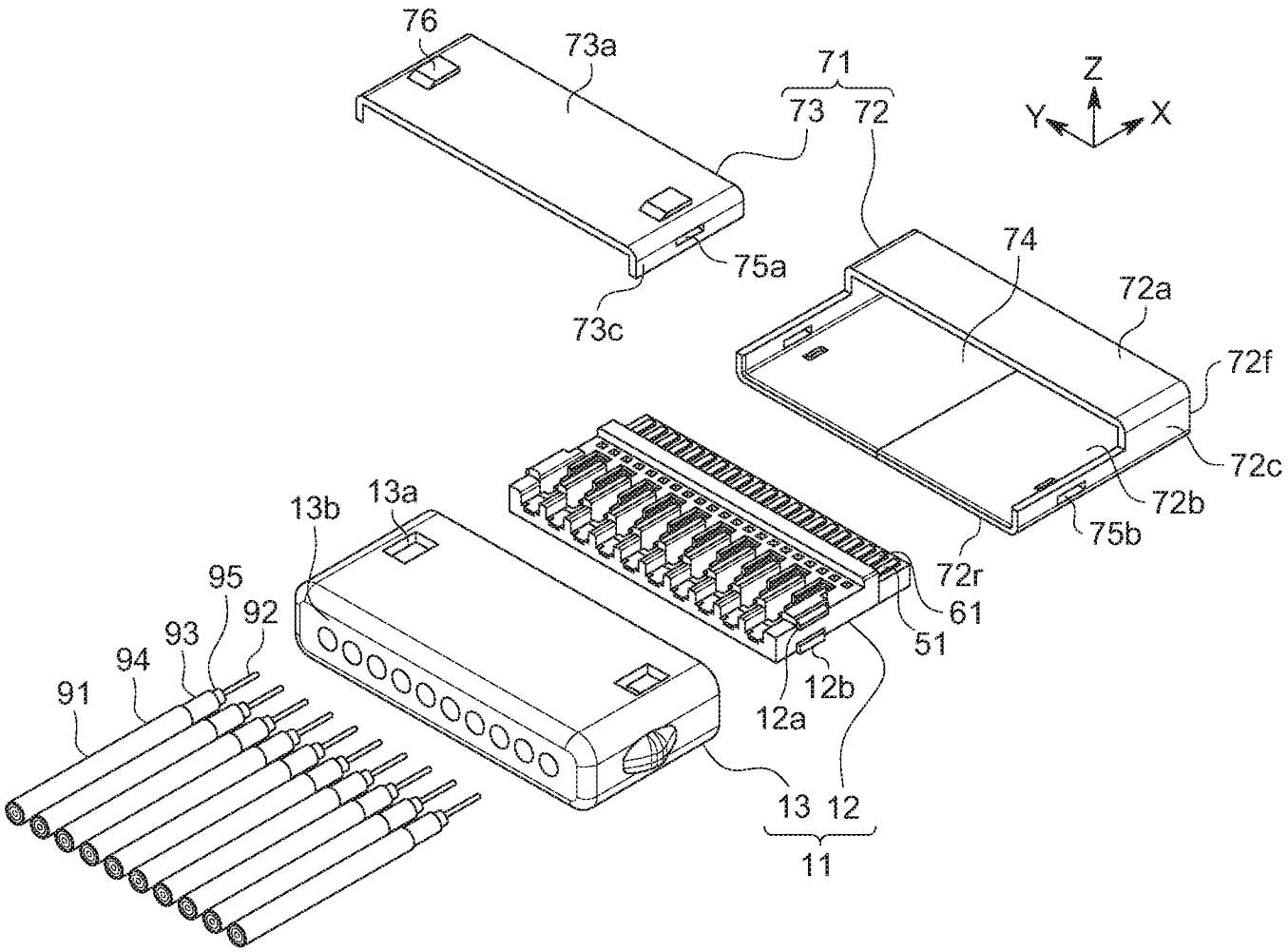
FIG. 2 is an exploded view of the cable connector according to the present embodiment.

FIG. 1 is a perspective view showing a state before fitting of a cable connector and a substrate connector according to the present embodiment, and FIG. 2 is an exploded view of the cable connector according to the present embodiment.

In the figures, reference number 1 denotes a cable connector serving as a connector according to the present embodiment, and is specifically, a coaxial multi-pole connector connected to a distal end of a coaxial cable 91 serving as a cable. In the example shown in the figure, ten coaxial cables 91 are arranged in one row in the width direction (Y-axis direction), at least one coaxial cable 91 merely needs to be provided and the number of coaxial cables can be appropriately changed. Furthermore, as shown in FIG. 1, the cable connector 1 is fitted with a substrate connector 101 serving as a counterpart connector mounted on a surface of the substrate 191, and is connected to the substrate 191 by being fitted with the substrate connector 101.

The substrate 191 may be, for example, a printed circuit board used in electronic devices such as computers, smart phones, tablets, and the like, electric devices such as household appliances, and the like; a flat plate shaped cable or the like referred to as a flexible circuit board (FPC), flexible flat cable (FFC), and the like, and may be any type of cable, but here, description will be made as being a printed circuit board used in electronic devices in which high-frequency signals are used such as smartphones and the like.

The coaxial cable 91 may be of any type, but is, for example, a coaxial cable having a small diameter suitable for transmitting high-frequency signals for wireless communication. Each coaxial cable 91 includes a conductive core wire 92 serving as a signal line made of a conductive metal arranged at the center, a substantially cylindrical dielectric 95 arranged to surround an outer periphery of the core wire 92, a shield 93 serving as a ground line made of a substantially cylindrical conductive metal arranged to surround an outer periphery of the dielectric 95, and an outer covering 94 having an insulating property arranged to surround an outer periphery of the shield 93.

It should be noted that in the present embodiment, expressions indicating directions such as up, down, left, right, front, and rear, which are used to explain the configurations and operations of the respective parts included in the cable connector 1, the substrate connector 101 and other members are not absolute but relative, and are appropriate when the respective parts included in the cable connector 1, the substrate connector 101 and the other members are in the orientation shown in the figure but should be interpreted with changes according to the change in orientation when the orientations of the respective parts included in the cable connector 1, the substrate connector 101 and the other members are changed.

The substrate connector 101 includes a counterpart shell 171 formed by performing processing such as die-cutting and bending on a conductive metal plate, a counterpart housing (not shown) made from an insulating material such as synthetic resin disposed in the counterpart shell 171, and a counterpart signal terminal 161 and a counterpart ground terminal 151 made from a conductive metal attached to the counterpart housing. The counterpart shell 171 has a flat, substantially rectangular parallelepiped shape so as to extend in the width direction (Y-axis direction), and is interiorly formed with an accommodating recess 113 to which at least a front end (X-axis positive direction end) of the cable connector 1 is inserted and accommodated. As shown in FIG. 1, the accommodating recess 113 is a space in which the side to be fitted with the cable connector 1 is open, and inside thereof, the counterpart signal terminal 161 and the counterpart ground terminal 151 are arranged and accommodated in one row in the width direction and so as to be alternately aligned. In the example shown in the figure, ten counterpart signal terminals 161 and eleven counterpart ground terminals 151 are provided, however, the number may be appropriately changed.

A soldering portion (not shown) of each counterpart signal terminal 161 and each counterpart ground terminal 151 is connected and fixed by soldering to a terminal connection pad (not shown) formed to be exposed on the surface of the substrate 191. As a result, the substrate connector 101 is fixed to the surface of the substrate 191, and each counterpart signal terminal 161 and each counterpart ground terminal 151 are conducted with a substrate side signal line and a substrate side ground line (not shown) formed on the substrate 191 so as to be connected to the corresponding terminal connection pad. Furthermore, the lower surface of a connection tail 172 of the counterpart shell 171 is connected and fixed by soldering to a shell connection pad 192 formed to be exposed on the surface of the substrate 191. As a result, the substrate connector 101 is fixed to the surface of the substrate 191, and the counterpart shell 171 is conducted with a substrate side ground line (not shown) formed on the substrate 191 so as to be connected to the shell connection pad 192.

As shown in FIG. 2, the cable connector 1 includes a housing 11 formed of an insulating material such as synthetic resin, and a shell 71 formed by performing processing such as die-cutting and bending on the conductive metal plate. The housing 11 includes an inner housing 12 serving as a housing for holding a terminal, and an outer housing 13, and the shell 71 includes a lower shell 72 and an upper shell 73.

It is to be noted that the inner housing 12 and the outer housing 13 are members integrated with another member by over-molding (insert molding) and do not exist alone in a state separated from the other members, however, they are depicted as existing alone in FIG. 2 for the sake of convenience of explanation.

The signal terminal 61 and the ground terminal 51 made of conductive metal are integrally attached to the inner housing 12 by over-molding (insert molding) The signal terminal 61 and the ground terminal 51 are arranged in one row in the width direction and so as to be alternately aligned, and are integrated with the inner housing 12. Furthermore, the core wire 92 of the coaxial cable 91 is connected to the signal terminal 61, and the shield 93 of the coaxial cable 91 is connected to the ground terminal 51. In the example shown in the figure, ten signal terminals 61 and eleven ground terminals 51 are provided, however, the number may be appropriately changed, for example, according to the number of coaxial cables 91. Note that, in a predetermined length range from the front end, that is, the distal end (X-axis positive direction end) of each coaxial cable 91, as shown in FIG. 2, the outer covering 94, the shield 93, and the dielectric 95 are removed, and the core wire 92, the dielectric 95, and the shield 93 are sequentially exposed from the distal end. Thus, the core wire 92 and the shield 93 are connected to the signal terminal 61 and the ground terminal 51, and the distal end of the coaxial cable 91 can be connected to the inner housing 12 by soldering.

The inner housing 12 to which the distal end of the coaxial cable 91 is connected is accommodated in the lower shell 72. As shown in FIG. 2, the lower shell 72 is a square tube shaped member having an outer shape of a flat, substantially rectangular parallelepiped shape so as to extend in the width direction (Y-axis direction), and includes a flat plate shaped bottom plate portion 72*b* extending along an X-Y plane, a flat plate shaped top plate portion 72*a* parallel to the bottom plate portion 72*b*, and a pair of left and right side plate portions 72*c* that extend along an X-Z plane and couple both end edges in the width direction of the bottom plate portion 72*b* and the top plate portion 72*a*.

Note that the top plate portion 72*a* is present in a first predetermined length range from the front end 72*f* of the lower shell 72 toward the rear side but is not present in a second predetermined length range from the rear end 72*r* of the lower shell 72 toward the front side, and the second predetermined length range becomes a top plate defective portion 74. In the example shown in the figure, first predetermined length<second predetermined length is satisfied. In the top plate defective portion 74, the height (dimension in the Z-axis direction) of the left and right side plate portions 72 *c* is approximately half, but an engagement opening 75*b* is formed in the side plate portion 72*c*.

The inner housing 12 to which the distal end of the coaxial cable 91 is connected is introduced into the lower shell 72 from the top plate defective portion 74 and accommodated therein. At this time, a lower engagement protrusion 12*b* formed on the left and right side surfaces of the inner housing 12 enters and engages with the engagement opening 75*b*. The inner housing 12 is thereby held at a predetermined position in the lower shell 72.

When the inner housing 12 is accommodated and held at a predetermined position in the lower shell 72, the upper shell 73 is attached. The upper shell 73 is a member in which a shape seen from the front-rear direction (X-axis direction) is substantially a gate shape, and includes a flat plate shaped main body portion 73*a* extending along the X-Y plane, and a pair of left and right half-side plate portions 73*c* extending along the X-Z plane and extending downward (Z-axis negative direction) from both end edges in the width direction of the main body portion 73*a*. The upper shell 73 has a length (dimension in the X-axis direction) that is equivalent to the second predetermined length so as to close the entire top plate defective portion 74. Furthermore, the engagement opening 75*a* is formed in the half-side plate portion 73*c*. Therefore, when the upper shell 73 is attached, the upper engagement protrusion 12*a* formed on the left and right side surfaces of the inner housing 12 held in the lower shell 72 enters and engages the engagement opening 75*a*, whereby the upper shell 73 is held at a predetermined position to cover the upper side of the inner housing 12 and close the entire top plate defective portion 74.

Then, the inner housing 12 to which the distal end of the coaxial cable 91 is connected is accommodated in the lower shell 72, and furthermore, after the entire top plate defective portion 74 is closed by the upper shell 73, the outer housing 13 is formed to be integrated with the shell 71, the signal terminals 61, and the inner housing 12 by over-molding (insert molding). Thus, the cable connector 1 as shown in FIG. 1 can be obtained. The resin forming the outer housing 13 is formed to enter a space between the lower shell 72 and the upper shell 73 from the rear end 72*r* of the lower shell 72 and cover the outer peripheries of the lower shell 72 and the upper shell 73 corresponding to a majority of the top plate defective portion 74. The engagement protrusion 76 formed on the upper surface of the main body portion 73*a* of the upper shell 73 enters and engages with the engagement opening 13*a* formed at a position corresponding to the top plate of the outer housing 13. Furthermore, a cable passage hole 13*b* through which the coaxial cable 91 passes is formed in the rear plate of the outer housing 13.

Next, a connection structure between the distal end of the coaxial cable 91 and the inner housing 12 will be described in detail.

Figure 3:
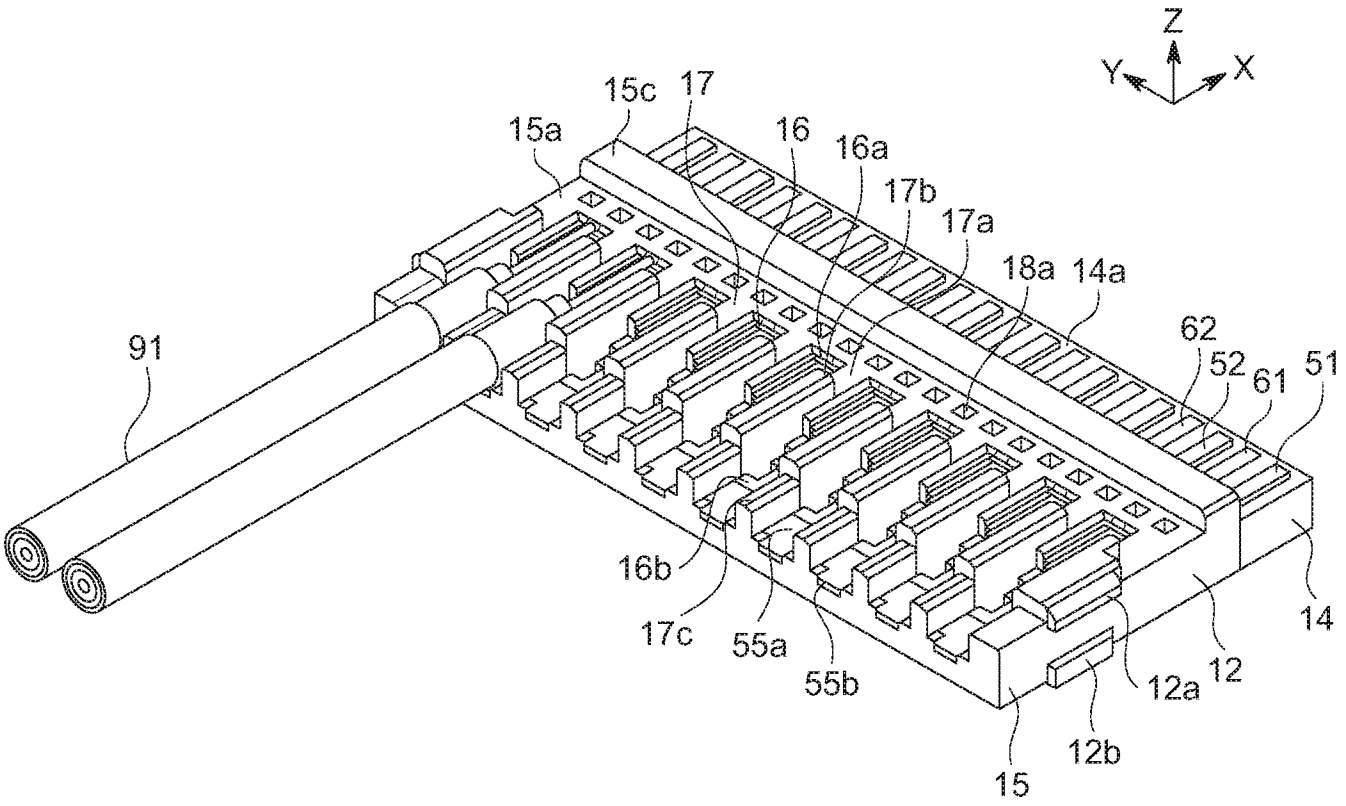
FIG. 3 is a perspective view showing a state in which the distal end of the coaxial cable is connected to the inner housing according to the present embodiment.
Figure 4:
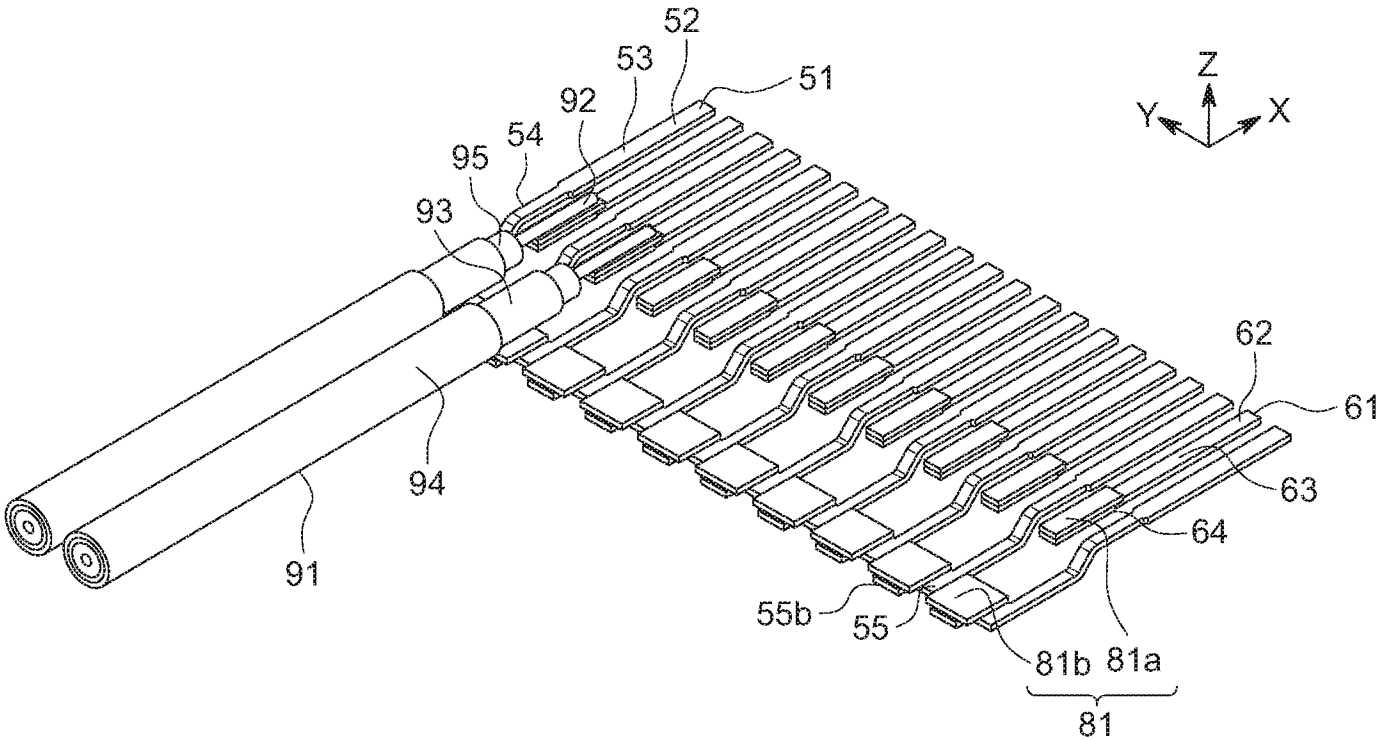
FIG. 4 is a perspective view showing a state in which the distal end of the coaxial cable is connected to the signal terminal and the ground terminal according to the present embodiment.
Figure 5A:
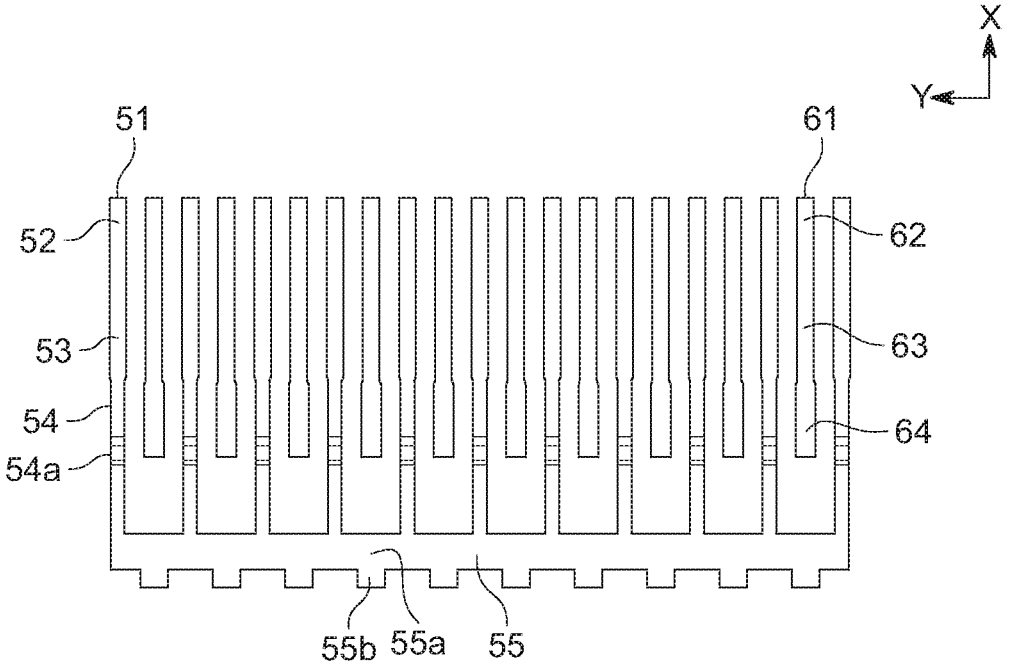
FIGS. 5A and 5B are two-sided views showing the signal terminal and the ground terminal according to the present embodiment, where
Figure 5B:
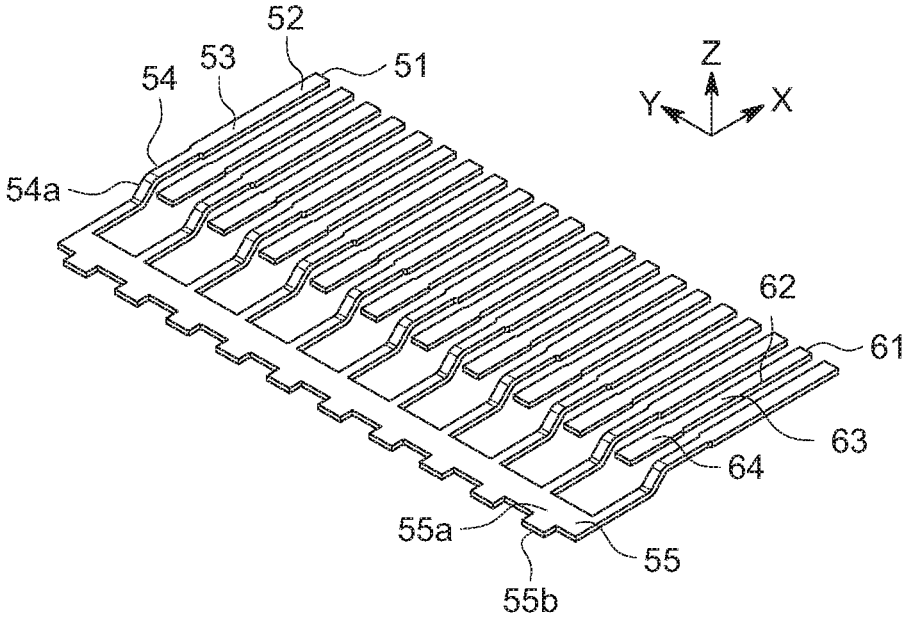
Figure 6C:
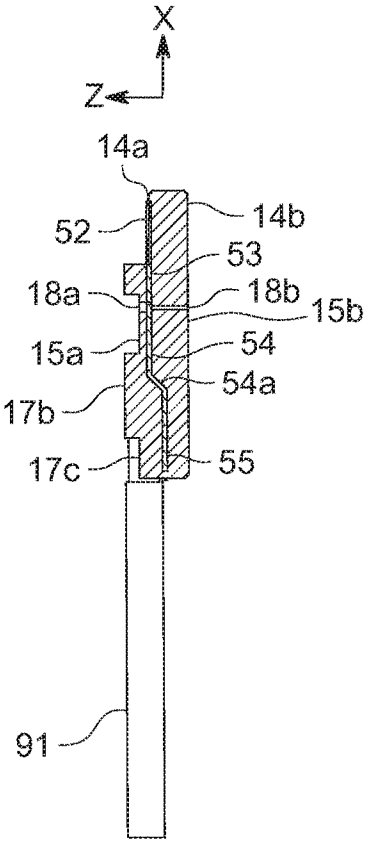
FIGS. 6A-6C are three-sided views showing a state in which the distal end of the coaxial cable is connected to the inner housing according to the present embodiment, where
Figure 6B:
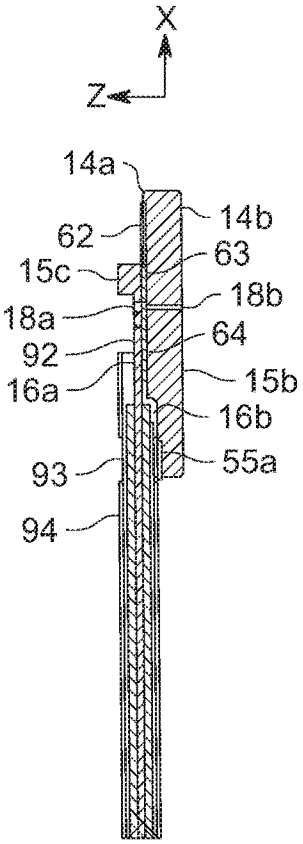
Figure 6A:
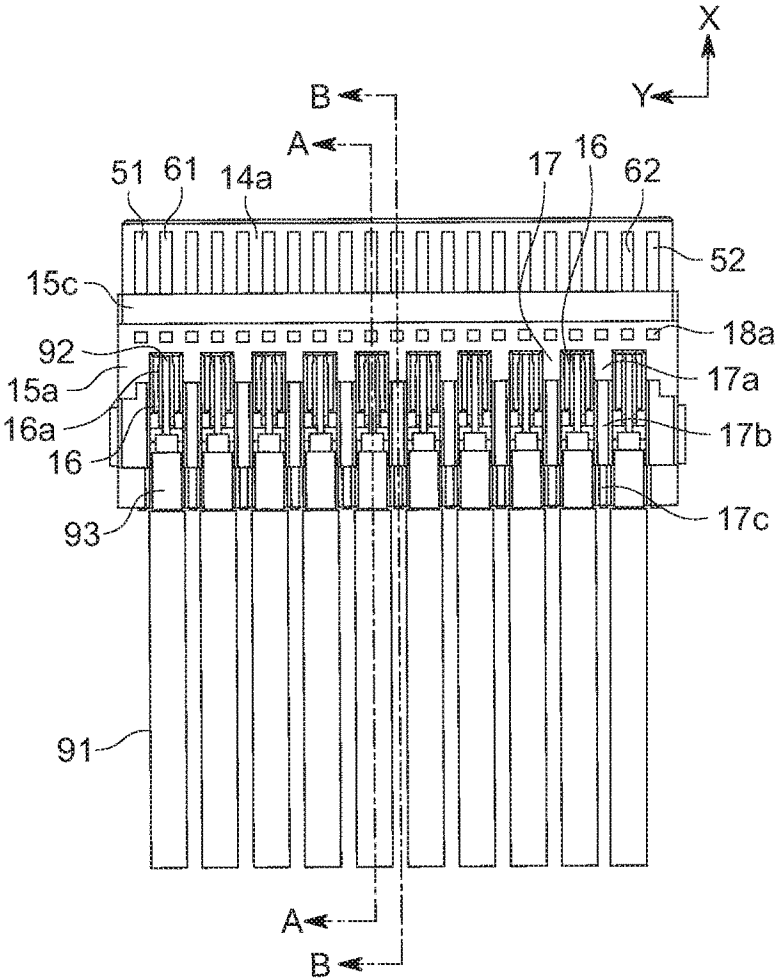
Figure 7:
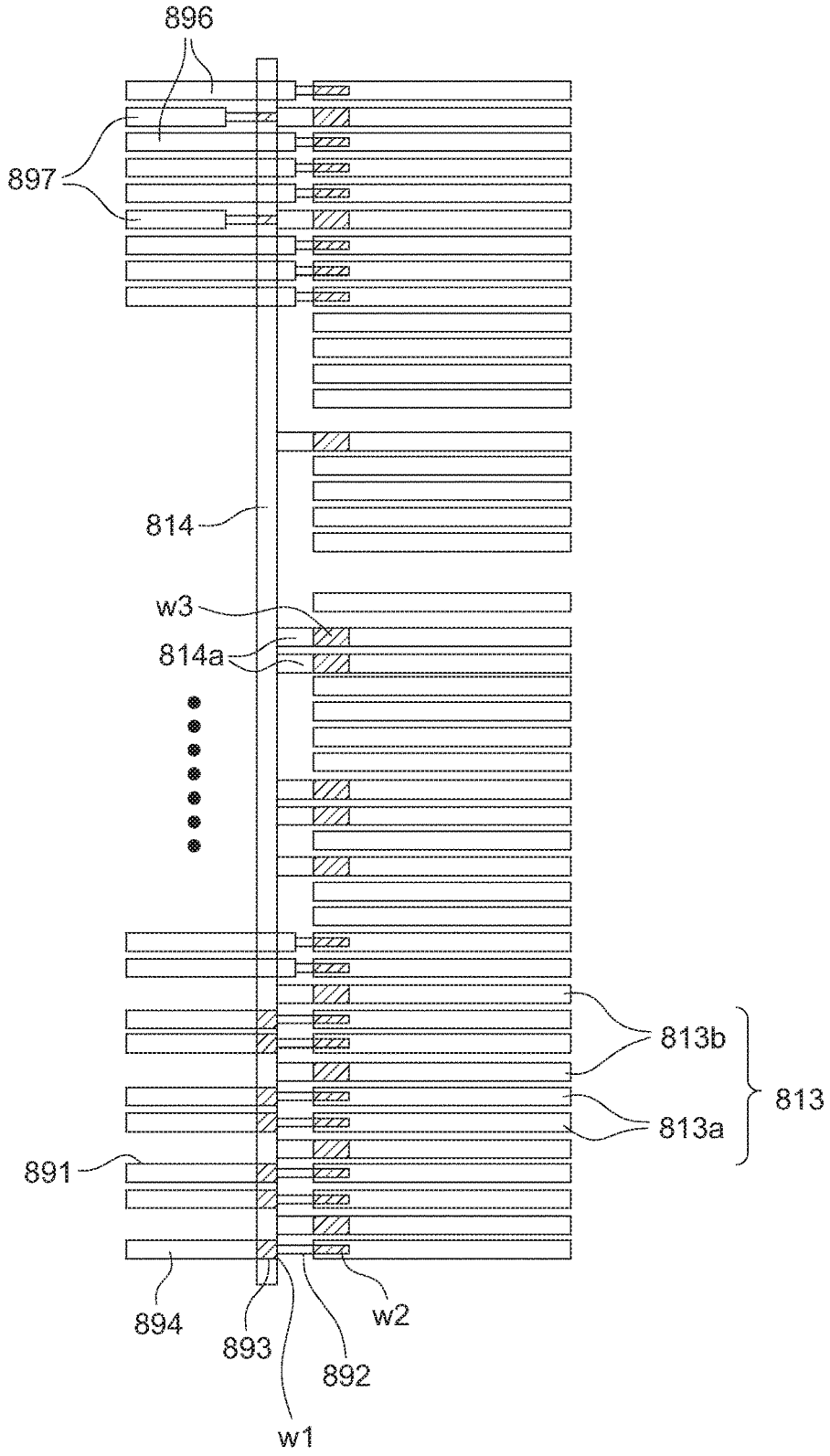
FIG. 7 PRIOR ART
FIG. 7 is a schematic plan view showing a state in which a coaxial cable is connected to a known connector.

FIG. 3 is a perspective view showing a state in which the distal end of the coaxial cable is connected to the inner housing according to the present embodiment; FIG. 4 is a perspective view showing a state in which the distal end of the coaxial cable is connected to the signal terminal and the ground terminal according to the present embodiment; FIGS. 5A and 5B are two-sided views showing the signal terminal and the ground terminal according to the present embodiment; and FIGS. 6A-6C are three-sided views showing a state in which the distal end of the coaxial cable is connected to the inner housing according to the present embodiment. In FIGS. 5A and 5B, FIG. 5A is a plan view and FIG. 5B is a perspective view; and in FIGS. 6A-6C, FIG. 6A is a plan view, FIG. 6B is a cross-sectional view taken along line A-A in FIG. 6A, and FIG. 6C is a cross-sectional view taken along line B-B in FIG. 6A.

In the present embodiment, each signal terminal 61 is a member formed by performing die-cutting, bending and the like on a conductive metal plate, and as shown in FIGS. 5A and 5B, is a member having an elongated band-like shape extending in the front-rear direction and a planar shape along the X-Y plane. Furthermore, each signal terminal 61 includes a main body portion 63, a contact portion 62 extending from a front end of the main body portion 63 toward the front side, and a tail portion 64 serving as a soldering portion extending from the rear end of the main body portion 63 toward the rear side. Note that the width (dimension in the Y-axis direction) of the contact portion 62 and the main body portion 63 is the same, however, the width of the tail portion 64 is wider than the width of the contact portion 62 and the main body portion 63.

Furthermore, the main body portion 63 is a portion that is embedded in the main body portion 15 of the inner housing 12 and held by the main body portion 15. Furthermore, the contact portion 62 is a portion in which at least the upper surface is exposed on the upper surface 14*a* of a tongue 14 of the inner housing 12 and brought into contact with the counterpart signal terminal 161 when the cable connector 1 is fitted with the substrate connector 101. Furthermore, the tail portion 64 is a portion in which at least the upper surface is exposed in a cable accommodating groove 16 formed in the main body portion 15 of the inner housing 12 and connected to the core wire 92 of the coaxial cable 91 by soldering.

Moreover, each ground terminal 51 is a member formed by performing die-cutting, bending and the like a conductive metal plate, and as shown in FIGS. 5A and 5B, is a member having an elongated band shape extending in the front-rear direction. Each ground terminal 51 includes a main body portion 53, a contact portion 52 extending from a front end of the main body portion 53 toward the front side, and a coupling portion 54 extending from a rear end of the main body portion 53 toward the rear side. The contact portion 52 and the main body portion 53 extend within the same plane along the X-Y plane, however, the coupling portion 54 includes a stepped portion 54*a* in the middle, where a portion on the front side of the stepped portion 54*a* extends within the same plane as the contact portion 52 and the main body portion 53 and a portion on the rear side of the stepped portion 54*a* extends within a plane lower (located in the Z-axis negative direction) than the contact portion 52 and the main body portion 53. In addition, the width (dimension in the Y-axis direction) of the contact portion 52 and the main body portion 53 is the same, but the width of the coupling portion 54 is narrower than the width of the contact portion 52 and the main body portion 53.

Furthermore, the main body portion 53 is a portion that is embedded in the main body portion 15 of the inner housing 12 and held by the main body portion 15. Furthermore, the contact portion 52 is a portion in which at least the upper surface is exposed on the upper surface 14*a* of the tongue 14 of the inner housing 12 and brought into contact with the counterpart ground terminal 151 when the cable connector 1 is fitted with the substrate connector 101. Furthermore, the rear ends of the coupling portions 54 of all of the ground terminals 51 are connected to a ground coupling plate 55 serving as a single ground coupling member extending in the width direction. The ground coupling plate 55 extends within the same plane as the portion of the coupling portion 54 on the rear side of the stepped portion 54*a*. As shown in FIG. 5A, a plurality of ground terminals 51 (11 in the example shown in the figure) extending in the front-rear direction are arranged in a width direction so as to create a space between each other in plan view, and the rear ends of each of the coupling portions 54 are connected to a single ground coupling plate 55 extending in the width direction, and thus it can be also said that the arrangement is similar to that of a comb tooth.

Furthermore, one signal terminal 61 extending in the front-rear direction is disposed in each of the spaces between the adjacent ground terminals 51. In the example shown in the figure, the interval between the ground terminal 51 and the signal terminal 61, that is, the pitch, is all constant. Moreover, the positions of the front end of the ground terminal 51 and the front end of the signal terminal 61 in the front-rear direction are the same, and the length (dimension in the X-axis direction) of the signal terminal 61 is shorter than the length of the ground terminal 51, and thus the rear end of the signal terminal 61 does not come into contact with the ground coupling plate 55. The contact portion 62 and the main body portion 63 of the signal terminal 61 extend within the same plane as the contact portion 52 and the main body portion 53 of the ground terminal 51, and have the same length. As described above, the tail portion 64 of the signal terminal 61 has a wider width than the contact portion 62 and the main body portion 63, however, the coupling portion 54 of the ground terminal 51 has a narrower width than the contact portion 52 and the main body portion 53, so that the interval between the tail portion 64 in the signal terminal 61 and the coupling portion 54 in the ground terminal 51 adjacent to each other is substantially the same as the interval between the contact portion 62 and the main body portion 63 in the signal terminal 61 and the contact portion 52 and the main body portion 53 in the ground terminal 51. Therefore, when connecting the tail portion 64 of the signal terminal 61 and the core wire 92 of the coaxial cable 91 by soldering, the soldering area is enlarged by the wide tail portion 64, and the soldering properties are improved. Furthermore, since the width of the coupling portion 54 is narrow, the coupling portion 54 adjacent to the tail portion 64 is reliably covered by a rib portion 17 described below, and the molten solder can be prevented from adhering to the coupling portion 54 of the ground terminal 51. Therefore, the possibility of a short circuit between the signal terminal 61 and the ground terminal 51 is extremely low due to soldering, whereby the soldering workability improves.

In the ground coupling plate 55, an intermediate portion between the areas where the coupling portions 54 are connected in the adjacent ground terminals 51 functions as a shield connecting portion 55*a* connected by soldering to the shield 93 of the coaxial cable 91. The position in the width direction of the shield connecting portion 55*a* is the same as the position of the tail portion 64 of the signal terminal 61. Note that in the example shown in the figure, a connection enlarged portion 55*b* projecting rearward from each shield connecting portion 55*a* is formed in the ground coupling plate 55, however, the connection enlarged portion 55*b* may be omitted.

As shown in FIG. 4, the coaxial cable 91 is desirably soldered to the signal terminal 61 and the ground coupling plate 55 using a solder preform 81. The solder preform 81 is a member formed into a plate shape of a predetermined size and shape by pre-processing the solder, and in the present embodiment, includes an elongated band-shaped core wire preform 81*a* mounted on the tail portion 64 of the signal terminal 61, and a shield preform 81*b* mounted on the shield connecting portion 55*a* of the ground coupling plate 55. When a distal end portion of the coaxial cable 91 is disposed at a predetermined position with respect to the inner housing 12, as shown in FIG. 4, the core wire preform 81*a* is interposed between the exposed core wire 92 and the tail portion 64 of the signal terminal 61, and the shield preform

81*b* is interposed between the exposed shield 93 and the shield connecting portion 55*a* of the ground coupling plate 55. Note that, in FIG. 4, for the sake of convenience of explanation, only two coaxial cables 91 are drawn, and other coaxial cables 91 are omitted.

When the solder preform 81 is heated in this state, the solder melts, thus soldering the core wire 92 and tail portion 64 and soldering the shield 93 and the shield connecting portion 55*a*. Note that the soldering work can be performed by applying molten solder between the core wire 92 and the tail portion 64 and between the shield 93 and the shield connecting portion 55*a* without using the solder preforms 81.

As described above, since the position in the width direction of the shield connecting portion 55*a* is the same as the position of the tail portion 64 of the signal terminal 61, and the ground coupling plate 55 connected to the rear end of the coupling portion 54 of the ground terminal 51 is lower (located in the Z-axis negative direction) than the tail portion 64 of the signal terminal 61, as shown in FIG. 6, the coaxial cable 91, in which the core wire 92 and the shield 93 are soldered to the tail portion 64 and the shield connecting portion 55*a* can maintain a substantially straight line even in side view.

As illustrated in FIG. 3, the inner housing 12 includes a substantially rectangular parallelepiped main body portion 15 having a rectangular shape in plan view, and a rectangular parallelepiped tongue 14 thinner than the main body portion 15 extending from the front end of the main body portion 15 toward the front side. The upper surface 14*a* of the tongue 14 is a flat surface, and the upper surface of the contact portion 62 of the signal terminal 61 and the upper surface of the contact portion 52 of the ground terminal 51 are exposed on the upper surface 14*a*.

Furthermore, a peak portion 15*c* that projects out upward and extends in the width direction is formed at the front end of the main body portion 15, so that the upper surface 14*a* of the tongue 14 and the upper surface 15*a* of the main body portion 15 are distinguished by the peak portion 15*c*. Since the upper surface 15*a* of the main body portion 15 is higher (located in the Z-axis positive direction) than the upper surface 14*a* of the tongue 14, the main body portion 63 of the signal terminal 61 and the main body portion 53 of the ground terminal 51 are embedded in the main body portion 15 and are not exposed to the upper surface 15*a* of the main body portion 15.

A plurality of upper pin marking holes 18*a* is opened at positions proximate to the peak portion 15*c* in the upper surface 15*a*, and lower pin marking holes 18*b* are opened at positions corresponding to each of the upper pin marking holes 18*a* in the lower surface 15*b* of the main body portion 15. When integrally molding the inner housing 12 with the signal terminal 61 and the ground terminal 51 by overmolding (insert molding), each upper pin marking hole 18*a* and the lower pin marking hole 18*b* act as marks of an upper die pin and a lower die pin for holding down terminals used to sandwich each signal terminal 61 and each ground terminal 51 from above and below to hold them at predetermined positions in the molding die, and are formed at positions corresponding to the main body portion 63 of each signal terminal 61 and the main body portion 53 of each ground terminal 51. As shown in FIGS. 6A-6C, the upper pin marking hole 18*a* and the lower pin marking hole 18*b* are holes that reach from the upper surface 15*a* and the lower surface 15*b* of the main body portion 15 to the main body portion 63 of the signal terminal 61 and the main body portion 53 of each ground terminal 51 embedded in the main body portion 15. Note that the lower surface 15*b* of the main body portion 15 is a flat surface flush with the lower surface 14*b* of the tongue 14.

As shown in FIG. 3, a plurality of (ten in the example shown in the figure) cable accommodating grooves 16 extending in the front-rear direction is formed side by side in the width direction on the upper surface 15*a* of the main body portion 15. Each cable accommodating groove 16 is a groove formed to be recessed from the upper surface 15*a* of the main body portion 15 at a position corresponding to each signal terminal 61 in the width direction so as to accommodate a lower portion near the distal end of the corresponding coaxial cable 91, and extends from the rear side of the upper pin marking hole 18*a* to the rear end (X-axis negative direction end) of the main body portion 15. Furthermore, each cable accommodating groove 16 includes a front half portion 16*a*, which has a depth (dimension in the Z-axis direction) that is relatively shallow to mainly accommodate the core wire 92, and a rear half portion 16*b*, which has a depth that is deeper than the front half portion 16*a* to mainly accommodate the shield 93. Note that, in FIG. 3, for the sake of convenience of explanation, only two coaxial cables 91 are drawn, and other coaxial cables 91 are omitted.

Furthermore, at least the upper surface of the tail portion 64 of the corresponding signal terminal 61 is exposed at the bottom surface of the front half portion 16*a*, and at least the upper surface of the shield connecting portion 55*a* corresponding to the signal terminal 61 in the ground coupling plate 55 is exposed at the bottom surface of the rear half portion 16*b*.

Moreover, a plurality (eleven in the example shown in the figure) of rib portions 17 extending in the front-rear direction is formed side by side in the width direction at a portion corresponding to the upper side of the ground terminal 51 in the upper surface 15*a* of the main body portion 15. The rib portion 17 is a portion that also functions as a wall for defining both left and right sides of each cable accommodating groove 16, and extends from the rear side of the upper pin marking hole 18*a* to the rear end of the main body portion 15. Furthermore, each rib portion 17 includes a front portion 17*a*, which upper surface is flush with the upper surface 15*a* of the main body portion 15, an intermediate portion 17*b* connected to the rear end of the front portion 17*a* and projected upward so as to have a height higher than the front portion 17*a*, and a rear portion 17*c* connected to the rear end of the intermediate portion 17*b* and which upper surface is substantially flush with the upper surface of the front portion 17*a*. It is desirable that the height of the upper surface of the intermediate portion 17*b* is higher than the upper end of the shield 93 exposed in the coaxial cable 91 in a state the distal end is connected to the inner housing 12, as shown in FIGS. 6A-6C. The shield 93 thus can be prevented from coming into contact with the main body portion 73*a* of the upper shell 73.

As described above, since the left and right sides of each cable accommodating groove 16 are defined by the rib portion 17, workability of the work of mounting the core wire preform 81*a* and the shield preform 81*b* on the tail portion 64 of the signal terminal 61 and the shield connecting portion 55*a* of the ground coupling plate 55 exposed at the bottom surface of each cable accommodating groove 16 is improved. Furthermore, since each ground terminal 51 is covered by the corresponding rib portion 17, the holding thereof is ensured.

Moreover, normally, when forming the signal terminal 61 by performing processing such as die-cutting, bending, or the like on the conductive metal plate, the rear ends of the plurality of tail portions 64 are commonly connected to a metal plate, which is referred to as a carrier (not shown), but the ground coupling plate 55 connected to the coupling portion 54 of each ground terminal 51 extends within a plane lower than the tail portion 64 of each signal terminal 61 disposed between the adjacent ground terminals 51 due to the presence of the stepped portion 54*a,* and thus when arranging the signal terminal 61 and the ground terminal 51 in combination as shown in FIGS. 5A and 5B, the plurality of signal terminals 61 can be disposed between the adjacent ground terminals 51 all at once by gripping the carrier, which improves the workability. Note that the carrier is removed from the tail portion 64 after the signal terminal 61 is disposed in a predetermined position.

Thus, in the present embodiment, the cable connector 1 includes at least one signal terminal 61 extending in the front-rear direction, at least two ground terminals 51 extending in the front-rear direction disposed on both sides in the width direction of the signal terminal 61, and an inner housing 12 that holds the signal terminal 61 and the ground terminal 51; where all the ground terminals 51 are integrally formed with one ground coupling plate 55 extending in the width direction; the inner housing 12 is integrally formed with the signal terminal 61, the ground terminal 51, and the ground coupling plate 55 by insert molding; the signal terminal 61 has the contact portion 62 that comes into contact with the counterpart signal terminal 161 and the tail portion 64 that is soldered to the core wire 92 of the coaxial cable 91 exposed from the inner housing 12; the ground coupling plate 55 includes the shield connecting portion 55*a* that is exposed from the inner housing 12 at the rear side of the tail portion 64 of the signal terminal 61 and soldered to the shield 93 of the coaxial cable 91; and the ground terminal 51 has a portion other than the contact portion 52 that comes into contact with the counterpart ground terminal 151 embedded in the inner housing 12.

Thus, the number of parts can be reduced, the cost of the cable connector 1 can be reduced, noise can be suppressed, thus stabilizing signal quality, the soldering work can be performed easily and surely, and the reliability of the connector can be improved. Furthermore, electrical properties can be stabilized because the potential levels of all of the ground terminals 51 can be matched and shared while allowing for soldering.

In addition, the signal terminal 61 is provided as a plurality, the number of ground terminals 51 is a number only one larger than the number of signal terminals 61, and the signal terminals 61 and the ground terminals 51 are arranged so as to be alternately aligned in one row in the width direction. Thus, variations in signal characteristics can be suppressed.

Furthermore, the contact portion 52 of the ground terminal 51 is located at the same height as the contact portion 62 of the signal terminal 61, and the shield connecting portion 55*a* of the ground coupling plate 55 is located at a position lower than the tail portion 64 of the signal terminal 61. Therefore, the coaxial cable 91 in which the core wire 92 and shield 93 are soldered to the tail portion 64 and the shield connecting portion 55*a,* can maintain a substantially straight line.

Furthermore, the inner housing 12 includes the cable accommodating groove 16 that extends in the front-rear direction formed in the upper surface 15*a,* and the tail portion 64 of the signal terminal 61 and the shield connecting portion 55*a* of the ground coupling plate 55 are exposed at the bottom surface of the cable accommodating groove 16. Thus, in a case where soldering is performed using the solder preform 81, the solder preform 81 can be easily mounted at a predetermined position, the workability of soldering can be improved, and automation of soldering work can be enabled.

Moreover, the inner housing 12 includes the rib portion 17 that extends in the front-rear direction formed on both sides of the cable accommodating groove 16, and a majority of the portion of the ground terminal 51 embedded within the inner housing 12 is located below the rib portion 17. Thus, the ground terminal 51 is held at a position away from the upper surface 15*a* of the inner housing 12. Furthermore, the ground terminal 51 is prevented from coming into contact with the upper shell 73.

In addition, the signal terminal 61 includes the main body portion 63 connected to the rear end of the contact portion 62; the tail portion 64 is wider than the contact portion 62 and the main body portion 63 and is connected to the rear end of the main body portion 63; the ground terminal 51 includes the main body portion 53 connected to the rear end of the contact portion 52 and the coupling portion 54 connected to the rear end of the main body portion 53; and the coupling portion 54 has a narrower width than the contact portion 52 and the main body portion 53. Accordingly, the tail portion 64 of the signal terminal 61 can be made wide to ensure soldering with the core wire 92, and furthermore, as the distance with the coupling portion 54 of the adjacent ground terminal 51 does not become narrow even if the tail portion 64 of the signal terminal 61 is made wide, the impedance can be stably maintained.

Furthermore, the coupling portion 54 includes the stepped portion 54*a,* and the rear end is integrally connected to the ground coupling plate 55. Thus, the shield connecting portion 55*a* of the ground coupling plate 55 can be located at a position lower than the tail portion 64 of the signal terminal 61.

Furthermore, the inner housing 12 includes the upper pin marking hole 18*a* and the lower pin marking hole 18*b* opened to the upper surface 15*a* and the lower surface 15*b* at positions corresponding to the main body portion 63 of the signal terminal 61 and the main body portion 53 of the ground terminal 51. When integrally molding the inner housing 12 with the signal terminal 61 and the ground terminal 51 by insert molding, the upper pin marking hole 18*a* and the lower pin marking hole 18*b* act as marks of an upper die pin and a lower die pin for holding down terminals used to sandwich each signal terminal 61 and each ground terminal 51 from above and below to hold them at predetermined positions in the molding die, so that the positions of each of the signal terminals 61 and each of the ground terminals 51 can be stably held by using the upper die pin and the lower die pin.

Furthermore, the cable connector 1 further includes the shell 71 in which at least a part of the inner housing 12 is accommodated, and the ground terminal 51 is electrically separated from the shell 71. Thus, the shell 71 and the shield 93 of the coaxial cable 91 can be electrically separated, and the degree of freedom of noise suppression is improved. Furthermore, even when the potential of the shell 71, which is the frame ground (FG), fluctuates, the noise can be suppressed and hence the signal quality can be stabilized as FG and the potential of the shield 93 and ground terminal 51, which is the signal ground (SG), are separated. Moreover, as the shield 93 of the coaxial cable 91 is not connected to the shell 71, the amount of heat required for soldering can be reduced, and workability is improved.

Note that the disclosure of the present specification describes characteristics related to a preferred and exemplary embodiment. Various other embodiments, modifications, and variations within the scope and spirit of the claims appended hereto could naturally be conceived of by persons skilled in the art by summarizing the disclosures of the present specification.

The present disclosure can be applied to connectors.

The invention claimed is:

1. A connector comprising:

(a) at least one signal terminal extending in a front-rear direction; at least two ground terminals extending in the front-rear direction disposed on both sides in a width direction of the signal terminal; and a housing that holds the signal terminal and the ground terminal; wherein:

(b) all of the ground terminals are integrally formed with one ground coupling member extending in the width direction;

(c) the housing is integrally formed with the signal terminal, the ground terminal, and the ground coupling member by insert molding;

(d) the signal terminal has a contact portion that comes into contact with a counterpart signal terminal and a tail portion that is soldered to a core wire of a coaxial cable exposed from the housing;

(e) the ground coupling member includes a shield connecting portion that is exposed from the housing on a rear side of the tail portion of the signal terminal and soldered to a shield of the coaxial cable; and (f) the ground terminal has a portion other than a contact portion that comes into contact with a counterpart ground terminal embedded in the housing.

2. The connector according to claim 1, wherein the signal terminal is provided as a plurality, a number of the ground terminals is a number only one larger than a number of the signal terminals, and the signal terminals and the ground terminals are arranged to be alternately aligned in one row in the width direction.

3. The connector according to claim 1, wherein the contact portion of the ground terminal is located at a same height as the contact portion of the signal terminal, and the shield connecting portion of the ground coupling member is located at a position lower than the tail portion of the signal terminal.

4. The connector according to claim 1, wherein the housing includes a cable accommodating groove that extends in the front-rear direction formed in the upper surface, and the tail portion of the signal terminal and the shield connecting portion of the ground coupling member are exposed at the bottom surface of the cable accommodating groove.

5. The connector according to claim 4, wherein the housing includes a rib portion that extends in the front-rear direction formed on both sides of the cable accommodating groove, and a majority of the portion of the ground terminal embedded within the housing is located below the rib portion.

6. The connector according to claim 1, wherein the signal terminal includes a main body portion connected to a rear end of the contact portion, the tail portion is wider than the contact portion and the main body portion and is connected to a rear end of the main body portion, the ground terminal includes a main body portion connected to a rear end of the contact portion and a coupling portion connected to a rear end of the main body portion, and the coupling portion has a narrower width than the contact portion and the main body portion.

7. The connector according to claim 6, wherein the coupling portion includes a stepped portion, and a rear end is integrally connected to the ground coupling member.

8. The connector according to claim 6, wherein the housing includes holes opened to an upper surface and a lower surface at positions corresponding to the main body portion of the signal terminal and the main body portion of the ground terminal.

9. The connector according to claim 1, further comprising a shell in which at least a part of the housing is accommodated, and wherein the ground terminal is electrically separated from the shell.

* * * * *